United States Patent [19]

Boe

[11] 4,106,313

[45] Aug. 15, 1978

[54] SHEER STRETCH HOSE HAVING HIGH COMPRESSIVE FORCE UNIFORMITY, AND YARN

[75] Inventor: Norman W. Boe, Gulf Breeze, Fla.

[73] Assignee: Monsanto Company, St. Louis, Mo.

[21] Appl. No.: 130,351

[22] Filed: Apr. 1, 1971

Related U.S. Application Data

[63] Continuation-in-part of Ser. No. 773,716, Nov. 6, 1968, abandoned.

[51] Int. Cl.[2] ..... D04B 7/18

[52] U.S. Cl. ..... 66/202; 66/178 A

[58] Field of Search ..... 161/76, 77, 173, 175, 161/177; 57/140 B; 66/202; 139/421; 28/74 WT, 75

[56] References Cited

U.S. PATENT DOCUMENTS

| | | | |
|---|---|---|---|
| 2,805,465 | 9/1957 | Miller | 28/81 |
| 3,038,235 | 6/1962 | Zimmerman | 161/173 |
| 3,092,892 | 6/1963 | Ryan et al. | 161/173 |
| 3,111,805 | 11/1963 | Boyer | 57/140 BY |
| 3,214,411 | 10/1965 | Saunders et al. | 139/420 |
| 3,399,108 | 8/1968 | Olson | 66/202 X |
| 3,402,097 | 9/1968 | Knudsen et al. | 161/175 |
| 3,536,802 | 10/1970 | Uraya et al. | 264/171 |
| 3,700,544 | 10/1972 | Matsui | 161/175 |

FOREIGN PATENT DOCUMENTS

| | | | |
|---|---|---|---|
| 780,597 | 3/1968 | Canada | 161/173 |
| 19,615 | 8/1968 | Japan | 161/175 |
| 1,040,365 | 8/1966 | United Kingdom. | |

OTHER PUBLICATIONS

Kirk-Othmer, Encyclopedia of Chemical Technology, 2nd Ed., vol. 7, 1965, pp. 566-572.

Cook, J. Gordon, Handbook of Textiles Fibres, II Man-Made Fibers, Morrow Publ. Co. Ltd., England, 1968, pp. 291-292, 664.

*Primary Examiner*—Ronald Feldbaum

*Attorney, Agent, or Firm*—Kelly O. Corley

[57] ABSTRACT

A garment including a leg (hose) portion, having increased uniformity of compressive force over a wider range of flexing. The hose is knitted conventionally from a bicomponent yarn, one component being an acid-dyeable hard fiber and the other component being a particular type of elastomeric polyurethane resistant to acid dyes.

18 Claims, 12 Drawing Figures

SHEER STRETCH HOSE HAVING HIGH COMPRESSIVE FORCE UNIFORMITY, AND YARN

This application is a continuation-in-part of copending application Ser. No. 773,716, filed Nov. 6, 1968, now abandon.

The invention relates to novel hose having particularly desirable physical and aesthetic properties, and to the yarn from which the hose is knit.

Ladies' stretch hose fall into two distinct broad categories: sheer stretch and support. Several types of yarns suitable for making sheer stretch hose are known. Textured hard (non-elastomeric) filaments are typically textured by an edge crimping technique or by false-twist heat-setting. Further types of yarn disclosed as suitable for sheer stretch hose are those polyamide conjugate yarns disclosed in U.S. Pat. Nos. 3,399,108 and 3,418,199.All these known sheer stretch hose are quite stretchable at low applied force until the crimps in the filaments are nearly pulled out. Once this occurs, the force required for further stretching increases rapidly. These hose are designed for use in the region where significant crimp still exists in the filaments, and are unsuited for applying to the human leg a reasonably constant compressive force high enough to give useful support.

The other broad category of stretch hose is designed to apply a compressive force to the leg, and includes the heavy surgical hose and the so-called "sheer support" hose. Both these types rely on the use of wrapped spandex to provide a compressive force high enough to be useful. The "sheer support" hose are "sheer" only in comparison to the surgical hose, and are quite coarse when compared to the sheer stretch hose. In addition to the lack of sheerness, a single "sheer support" hose will provide the desired range of compressive force to the leg only for a relatively limited range of leg sizes. It is thus necessary to provide as many as eight sizes to accommodate the usual range of leg sizes.

According to the invention, the desirable attributes of the sheer stretch hose (sheerness and great stretchability) and the "sheer support" hose (desired compressive force on the leg) are combined in a single hose. These desirable attributes are in fact typically more pronounced in the novel hose of the invention than in either the sheer stretch or the "sheer support" hose.

A primary object of the invention is to provide a stretch hose having superior compressive force uniformity as the hose is stretched.

A further and separate object is to provide a stretch hose having less loss of compressive force upon being held in a stretched condition.

A further and separate object is to provide a stretch hose of remarkable apparent sheerness.

A further and separate object is to provide a novel conjugate yarn suitable for making hose of the above character.

Other objects will in part appear hereinafter and will in part be obvious from the following description taken in connection with the accompanying drawings, wherein.

Figure 1:
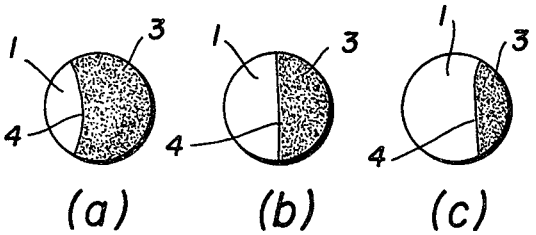
FIG. 1 illustrates a high magnification typical cross sections of circular section filaments made according to the invention.

The hose of the invention is conventionally knitted from a conjugate yarn, wherein a particular type of elastomer is conjugated with a hard fiber.

For many years it has been known to make textile filaments through the conjugation of two polymeric materials having dissimilar shrinkage or heat retraction characteristics. The fusion of the two substances is accomplished by bringing them together at or near the point of filament formation without intimate mixing so that the substances adhere to each other along the length thereof to form a continuous interface. This is known as a side-by-side arrangement of dissimilar polymers in a conjugate filament. A second method of conjugating such dissimilar polymers into a filament is to bring the polymers together at or near the point of spinning to provide in a continuous manner an eccentric core and skin arrangement of the polymers. In both arrangements, core-and-skin or side-by-side, the filaments are potentially crimpable. The crimp is developed after the filaments have been drawn and relaxed; and the crimp takes the form of a non-torque, randomly reversed helix.

Many factors must be considered in the selecting of dissimilar polymers for optimum conjugation. Often it is desirable to have a conjugate filament exhibiting the highest order of contraction of retractive force which is a measure of the longitudinally applied force required to remove the helical crimp and to straighten the filament. A side-by-side arrangement of polymer provides a much greater retractive force in the filament as compared with the eccentric sheath-core structures. Unfortunately, the side-by-side conjugate filaments may tend to split into two discrete sub-filaments during processing and use, particularly where the polymers are selected on the basis of the differences in their shrinkages. Another important factor in regards to melt spun conjugated filaments is extrudability of the two selected polymers within a narrow temperature range. When polymers have a desired adherence and contractive force, they normally have such different melting points that expensive and complex equipment is required to maintain the required temperature differential in order to prevent decomposition of the lower melting material and to assure proper conjugation of the polymers.

A major use of stretch yarns is in regular hosiery for both men and women. Because of the stretch, a few stock sizes of such hosiery fit any normal foot, eliminating the need for a wide range of specific hose sizes. The ankle and toe fit is much superior to that of hose made of non-stretch yarn, particularly of women. Many ordinary stretch hose become baggy and ill-fitting after a few wearings and launderings, which decidedly detracts from the overall appearance and long-term utility of the hosiery. Variable deformation of the stitches in hosiery and knitted fabrics of stretch yarns may also cause a "ratty" appearance that is aesthetically unattractive.

Sheerness is a highly desired characteristic in women's hosiery and is usually realized by adjusting the stitch and by making the size or denier of the yarn sufficiently small. Small yarns also have the advantage of making zones of deformed baggy stitches less obvious to the eye. Small filaments are more fragile, however, and such hosiery in more susceptible to picks and snags, and have short service life.

A further significant use of stretch yarns is in support hose worn by many people for physiological reasons. In order to provide adequate compressive forces to the legs, such hose ordinarily must be made of rather large yarns or filaments; for example, core-spun or wrapped stretch yarns of 100 denier or larger are frequently used. Hosiery made of such coarse yarns necessarily lack the sheerness of dress hose desired by women for reasons of style or general appearance.

Another important use of stretch yarns is in knitted form-fitting garments, such as stretch pants, ladies underwear, swimwear, and power net fabrics for girdles. Woven stretch fabrics, particularly fabrics stretchable in one direction, made by properly combining non-stretch and stretch yarns, are used for suitings and skirts.

Yarns according to the invention are especially useful for each of the above mentioned applications. Singular differential dyeing characteristics of the two polymeric components of the conjugate filaments enable a relatively large monofilament to appear quite sheer in ladies dress hose. The hard or non-elastomeric component will take up the normal hosiery dyes but the polyurethane component will remain substantially uncolored. Superior retractive forces and stretch recovery at a high degree of extension permits construction of durable support hose that have a desirable sheerness. Long-term stability of stretch recovery insures extended useful life of skirts and similar apparel of woven fabrics.

There is provided a novel and useful helically crimped bicomponent textile filament formed from specific materials. One component is a melt-spinnable fiber-forming polymer having a melting point in the range of about 180°-280° C.; the other component is an elastomeric polyurethane melt spinnable at a temperature of about 205°-240° C. and containing a block polyurethane segment melting higher than about 200° C. and below about 235° C. The two components are adherent along the length of the filament either in a side-by-side arrangement or in an eccentric sheath-core arrangement. The polyurethane component comprises about 20—80 weight percent of the fiber structure. The helically crimped filament exhibits a high retractive force when tensioned and a high degree of crimp and crimp uniformity as measured by the difference in the straightened and contracted length of a skein of the filaments.

According to a major aspect of the invention, the hard fiber is aciddyeable while the polyurethane is resistant to acid dyeing.

The invention also includes hosiery knitted of the bicomponent filaments, the hosiery being characterized by excellence of leg fit and high and uniform contractile power as well as a high degree of apparent sheerness and durability.

The method of producing the present bicomponent filament comprises melt extruding together the above-described component using conventional conjugate spinning apparatus for accomplishing the conjugating of the components either to produce a side-by-side arrangement of the components or to produce an eccentric sheath-core arrangement thereof. Many melt-spinning spinneret assemblies known in the art can be employed to provide such conjugation. Upon being extruded from the spinneret, the molten conjugated filament or filaments are cooled to solidify them. This is ordinarily accomplished by contacting the molten stream with a cooling gas. The filaments are stretched to increase the molecular orientation, to obtain the desired tensile strength and to provide the contractile force that develops the crimp. The helical crimp develops when the stretching force is removed. However, the intensity of the crimp retractive force may be increased and the boiling-water shrinkage of the filament can be reduced by a post-drawing heat treatment wherein the filaments are heated under low tension and then cooled.

One of the components used in the manufacture of the present filaments is chosen from the group of fiber-forming acid-dyeable polymers, such as polyamides, having a melting point in the range of about 180°-280° C. Among suitable members of this group are polyhexamethylene adipamide (nylon 66), polyhexamethylene sebacamide (nylon 610), polymeric 6-aminocaproic acid (nylon 6), polymeric 11-aminoundecanoic acid (nylon 11), polymeric 12-aminododecanoic acid (nylon12). The preparation of these polyamides is well known in the art and each is now available commercially from various manufacturers of plastics and synthetic fibers. Homopolymers are usually preferred although copolymers of these polyamides may be used provided their melting points are within the cited range and they are extrudable under practicable spinning conditions.

The particular choice of a polyamide is somewhat dependent upon the spinning equipment and upon the melting point of the polyurethane component to be used. The higher melting polyamides are preferably paired with the higher melting polyurethanes, particularly if the temperature of the entire spinning head is controlled at one temperature by a single thermostat. More elaborate spinning heads that provide independent temperature control of each polymer stream to a point just upstream of the spinneret permits a wider choice of polymer pairs.

Melting point has a major effect upon the quenching or solidification rate of the spinning filaments, but extrudability and spinning stability are more dependent upon the viscosity of the molten polymers. At the fiber-forming level, molecular weight increase of a polyamide increases the melting point of the polymer very slowly. Melt viscosity does increase appreciably with further increase in molecular weight. The so-called ultra-high molecular weight polyamides are therefore not suitable for conjugate extrusion with elastomeric polyurethanes because of excessive imbalance between the respective viscosities of the two melts. Polyamides with average molecular weights in the moderate to low range are preferred, provided they are at the fiber-forming stage.

The molecular weight range of polyamides useful according to the invention may be specified practically by the relative viscosity. Relative viscosity as used herein is the ratio of the viscosity of a solution of the polymer to the viscosity of the solvent, both viscosities being measured at 25° C. Different solvents are necessary for different polyamides, and the concentration of polymer in solvent is chosen arbitrarily and specified in Table I. Table I indicates the preferred ranges of relative viscosities of polyamides, all measured at 25° C. with solvents and polymer solution concentrations as indicated; concentrations are in terms of weight percent.

Table 1

| Polyamide | Melting Point, ° C | Solvent | Concentration of Polymer | Relative Viscosity Range |
|---|---|---|---|---|
| Nylon 6 | 225 | 90% formic acid, 10% water | 8.4% | 22–40 |
| Nylon 66 | 264 | 90% formic acid, 10% water | 8.4% | 20–45 |
| Nylon 610 | 218 | 85% phenol, 15% water | 5.0% | 11–18 |
| Nylon 11 | 187 | m-cresol | 8.4% | 42–80 |
| Nylon 12 | 179 | m-cresol | 0.5% | 1.4–1.9 |

The other component used in making helically crimped filaments is an elastomeric polyurethane melt extrudable at a temperature of about 205°–240° C. In combination with the polyamide conjugate melt, some polyurethanes not extrudable practically as a homofilament can be spun as a conjugate filament. Filaments extruded at temperatures below 200° C. usually have unsatisfactory physical properties, however, and stick to one another excessively so that the filaments cannot be unwound from bobbins at commercial speeds without excessive tension variations and filament breakage.

A major problem in spinning polyurethane homofilaments is the persistent tackiness of the freshly extruded filaments, surface solidification proceeding at a slow rate. A similar difficulty arises in spinning conjugate filaments with a polyurethane component. It has been found, however, that processing is highly practicable, provided the polymer contains a polyurethane segment melting higher than about 200° C. and below about 235° C., these melting points being measured by differential thermal analysis. These conjugate filaments solidify within a few feet of the spinneret and, with the application of common yarn finish solutions and emulsions, may be wound on bobbins and be processed further.

Either polyester-urethanes or polyether-urethanes are suitable. The polyether or polyester component must have an average molecular weight in the range of 800–3000 if excessive tackiness is to be avoided in the conjugate filaments; preferably the molecular weight of the polyether is limited to a range of 800–2500. Polyester-urethanes are usually preferred, being compatible with a wider range of hard fibers and processing conditions while providing excellent yarn properties.

Because minor variations in chemical structure and physical characteristics are difficult to determine adequately in general, the polyurethanes useful according to the invention are most conveniently described in terms of the chemical reactants used to prepare the polyurethane. Broadly, the polyurethanes are made by reacting together (1) a hydroxy-terminated polyester, or a polyether having an average molecular weight in the range 800–3000; (2) a diisocyanate, and (3) a glycol chain-extending agent.

Suitable polyesters have a molecular weight in the range of about 1000–3000 and are obtained by the normal condensation reaction of a dicarboxylic acid with a glycol or from a polymerizable lactone. Preferred polyesters are derived from adipic acid, glutaric and sebacic acid which are condensed with a moderate excess of such glycols as ethylene glycol; 1,4-butylene glycol; propylene glycols; diethylene glycol; dipropylene glycol; 2,3-butanediol; 1,3-butanediol; 2,5-hexanediol; 1,3-dihydroxy-2,2.4-trimethylpentane; mixtures thereof; etc. Useful polyesters may also be prepared by the reaction of caprolactone witha initiator such as glycol, preferably with the molecular weight of the product polyester being restricted to the range 1500–2000. Included among suitable polyethers having molecular weights in the range of 800–3000 are poly (oxyethylene) glycol; polyoxypropylene glycol; poly (1,4-oxyybutylene) glycol; poly(oxypropylene)-poly(oxyethylene) glycols; etc.

Diisocyanates suitable for the preparation of polyurethanes may be selected from a wide range of chemical classes, such as alicyclic, aromatic, aryl-aliphatic, and aliphatic diisocyanates. Particularly useful diisocyanates are: 2,4-tolylene diisocyanates; 4,4'-dicyclohexylmethane diisocyanate; 4,4'-diphenylmethane diisocyanate; meta or para-xylylene diisocyanate; 1,4-diisocyanato cyclohexane; hexamethylene diisocyanate; and tetramethylene diisocyanate.

According to one aspect of the invention, the polyurethane portion of the conjugate filament can be made resistant to acid dyeing by proper selection of the diisocyanate. Thus, acid dye resistance is achieved if the isocyanate groups are hydrolizable to give a reaction product having a pK value of at least 8 at 95° C. Examples are those diisocyanates wherein the -NCO group is directly attached to an aromatic nucleus, as in 4,4'-diphenylmethane diisocyanate. Further suitable diisocyanates for this purpose are those wherein the isocyanate groups are attached to a carbonyl group, such as $$O{=}C{=}N{-}\overset{\overset{\displaystyle O}{\|}}{C}(CH_2)_4\overset{\overset{\displaystyle O}{\|}}{C}{-}N{=}C{=}O,$$ or to a sulfonyl group, such as $$O{=}C{=}N{-}\underset{\underset{\displaystyle O}{\|}}{\overset{\overset{\displaystyle O}{\|}}{S}}{-}(CH_2)_4{=}\underset{\underset{\displaystyle O}{\|}}{\overset{\overset{\displaystyle O}{\|}}{S}}{-}N{=}C{=}O.$$

Diisocyantes unsuitable for this particular purpose as those wherein isocyanate groups are attached to a methylenic carbon, such as in the tolylene or xylylene diisocyanates, and hexamethylene diisocyanate.

Many different common glycols may be used as chain-extending or curing agents. Among these materials are: 1,4butanediol; ethylene glycol; propylene glycol; 1,4-bis-($\beta$-hydroxyethoxy)benzene. The combination of isocyanate and glycol, both as to type and amount, must be chosen so as to provide a DTA melting point in the range of about 200°–235° C.

The chemistry and preparation of elastomeric polyurethanes is treated comprehensively in *Polyurethanes: Chemistry and Technology,* by J. H. Saunders and K. C. Frisch, Part II, Chapter 9, Interscience Publishers, Inc. (1964). U.S. Pat. No. 3,214,411 issued to Saunders and Piggott may be consulted for specific details on the process of preparation of polyester-urethanes for filaments according to the present invention.

Particularly advantageous polyester-urethanes may be made by selecting certain specific reactants and combining them within fairly narrow ranges of proportions as indicated by this general recipe:

100 parts by weight of poly(1,4-butylene) adipate having a molecular weight of 1500–2000;

55–110 parts by weight of 4,4′-diphenylmethane diisocyanate; and sufficient glycol to give a total NCO-/OH ratio in the range of 1.01–1.04. The preferred chain-extending glycols are ethylene glycol; 1,4-butane diol; and 1,4-bis-($\beta$-hydroxyethoxy)benzene which is the glycol represented by the formula $HOCH_2CH_2O$

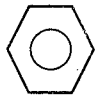

$OCH_2CH_2OH$.

In the above formulation the NCO/OH ratio is an abbreviation for the ratio of equivalents of isocyanate groups to the total equivalents of hydroxy groups in the chain-extending glycol combined with the reactive groups in the polyester. The optimum molecular weight and polymer melt strength for maximum spinning speeds without the breaking of fine denier filaments are obtained when the NCO/OH ratio is in the range of about 1.01–1.04.

The polyurethanes in filaments of the invention, as previously noted, are regarded as block copolymers in which the polyurethane block melts at a temperature above about 200° C. but below about 235° C. This melting point is measured by differential thermal analysis (DTA), and is indicated by a distinct endothermic peak in the thermogram as the base temperature of the polymer sample is raised. A general description and discussion of DTA methods is given in *Organic Analysis,* edited by A. Weissberger, Vol. 4, pp. 370–372, Interscience Publishers, Inc. (1960), and in various encyclopedias of chemical technology. In the examples cited below, the DTA melting points were measured with a commercial du Pont 900 DTA Instrument, manufactured by E. I. du Pont de Nemours, Inc.

The two components (polyurethane-polyamide) are preferably extruded through single spinneret orifices in side-by-side relation; this arrangement provides the highest order of retractive force to the crimps. However, it is possible to extrude the two components through separate juxtaposed orifices and to coalesce the two extruded streams of molten polymer just below the extrusion face of the spinneret; this method is preferred with higher melting polyamides, such as nylon 66. When a crimp of reduced retractive force can be used a sheath-core structure of the polymers is made, provided that the core is eccentrically arranged with respect to the long axis of the filament. The sheath-core structure is preferred where extremely uniform dyed appearance in the ultimate textile product is of importance. The two components are preferably present in approximately equal amounts by weight, but the relative amounts of the two components may vary from about 20–80% to 80–20% and a highly crimped structure is assured when at least 30% of the cross section of the spun filament is comprised of the polyurethane component. After extrusion the composite filament must be stretched. The filament can be cold-stretched or, if desirable, be hot-stretched as long as the desired tensile strength is obtained without unduly disrupting the adherence of the two components. After stretching, the filament may be heated under low tensile loading. These relaxing conditions are usually selected to induce the desired low degree of boiling water shrinkage and to heat-set the crimp in the polyamide component of the filament. The precise conditions for stretching and relaxation can be selected without undue difficulty by a skilled artisan.

FIGS. 1 A, 1 B, and 1 C illustrate the appearance of actual cross sections of typical filaments according to the invention, each filament having a substantially circular periphery. However, non-circular section filaments are also included in the scope of the invention. The filament is composed of an elastic polyurethane component 1 and a polyamide component 3 which are united at interface 4. The interface may be substantially planar or straight as shown in B, or it may be more or less curved as indicated in A and C. Ordinarily, it is desirable to have a planar or straight interface since this indicates that interfacial tension relative to the viscosity of the molten components is well matched under the particular extrusion conditions employed in spinning.

A freshly spun homofilament of the elastomeric polyurethane polymer after being stretched 300–600% will contract to within 15–25% of its initial length when the tensile load is removed. A similarly stretched homofilament of the polyamide contracts only 4–6% and remains at about 285–570% of its initial length when the tensile load is removed. This extreme difference in elastic recovery of the unstretched components provides the motive force that develops the unique crimp and recovery power of filaments according to the invention.

Figure 2:
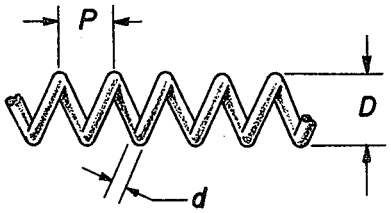
FIG. 2 represents a lateral view at lower magnification of a short segment of a freshly stretched filament under a moderate axial tensile load.

When a spun conjugate filament according to the invention is handdrawn to a draw ratio of about 2:1 or less and is released, the drawn portion immediately contracts, assuming the configuration of a few large loose turns of a right-circular helix somewhat similar to the form illustrated in FIG. 2. FIG. 2 also defines some terms convenient for description of the filament. "P" is the lead of the helix, or the distance traversed along the axis of the helix by a point when its radius vector rotates through one complete revolution; "D" is the diameter of the helix, actually illustrated as the outside diameter; and "d" is the diameter of the filament itself. These dimensions may be conveniently expressed in units of mils or thousandths of an inch.

Figure 3:
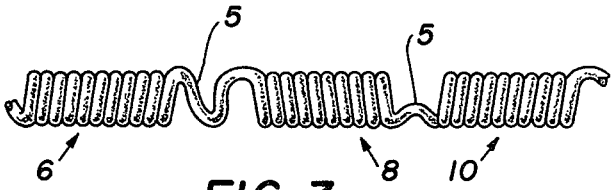
FIG. 3 represents another lateral view at lower magnification of a longer segment of a freshly stretched filament under substantially zero axial tensile load.

When a spun conjugate filament of the invention is hand-drawn to a draw-ratio greater than about 2.5:1, preferably greater than 3:1, and is released, the filament immediately contracts into a chain of uniform right circular helices as illustrated in FIG. 3. The helical segments in the chain alternate from right to left-hand helices as indicated by segments 6, 8, and 10. Dislocations or reversal points 5 occur between the segments of reversed helices. These helical segments comprise a "close" helix in which the turns are at the closest possible spacing P, in contrast with an "open" helix as illustrated in FIG. 2.

The close helix configuration of freshly drawn filaments is regarded as the "equilibrium form" of drawn filaments according to the invention. That is, the filament assumes this configuration when permitted to contract without external restraint. All drawn filaments have the potential to assume the close helical form and will do so under appropriate conditions. This potential equilibrium close helix configuration provides an explanation of certain important characteristics of the yarn of the invention even though the yarn does not always apparently achieve this configuration. A machine-drawn filament that has been stored under tension on a bobbin for a protracted period of time, for example, does not immediately contract into a close helix when it is released. Instead, the filament progressively contracts, passing through the stages of large open helix, small open helix, and finally into the compact close helix, the time required for this transformation varying from a few minutes to several minutes depending upon the ambient humidity and temperature.

For production process control and for characterization of the filaments of the invention in relation to end usage, an arbitrary measurable factor termed "bulk" is useful. The procedure is to form a skein of yarn by winding the filament or yarn onto a denier reel having $1\frac{1}{8}$ meter periphery. Sufficient yarn is wound on the reel to provide a total skein denier of 4500; for example, 112.5 revolutions of 20 denier monofilament. One end of the skein is looped over a supporting hook, and another hook bearing a weight equivalent to 0.33 gm. per skein denier is passed through the other end of the skein. After the weight has been freely supported by the skein for exactly 10 seconds, the length of the skein is measured and designated "A". The heavy weight is replaced with a very small weight (0.0013 gm./denier), and the skein with weight is immersed for exactly 60 seconds in boiling water at least as deep as the skein is long. The skein is removed from the water, suspended without the weight and allowed to dry 12 hours in air at 74 ± 1° F. and 72% relative humidity. The small weight is now hung on the dry skein and the skein length of the highly crimped yarn is measured 10 seconds after the weight was attached; this length is designated "B". Next the small weight is replaced by the large weight (0.33 gm./denier), and the final skein length "C" is recorded after 10 seconds. The bulk and the shrinkage are calculated from these measurements:

$$\% \text{ Bulk} = \frac{C - B}{C} \times 100 \qquad \text{(Equation 1)}$$

$$\% \text{ Shrinkage} = \frac{A - C}{A} \times 100 \qquad \text{(Equation 2)}$$

% Bulk is a measure of the axial stretch the yarn undergoes in passing from the highly crimped to the substantially straightened configuration. Fabric appearance correlates with the uniformity of the % Bulk of a stretch yarn. Appreciable variation in % Bulk along a yarn, particularly monofilaments, leads to stitch variations that cause an irregular "ratty" appearance in the knitted fabric, this effect is often noticed in fabrics knitted of conjugate filaments whose crimps are generated by differential shrinkage of the polymeric components.

Surprisingly, filaments of the invention have a very stable bulk level. For a given nominal denier and given draw ratio, the % Bulk level of the filaments is remarkably constant and does not vary significantly along the filament provided the filament cross section is comprised of at least 30% of the polyurethane. The % Bulk of a filament containing 40% polyurethane component, for example, does not differ appreciably from the % Bulk of a filament containing 60% polyurethane, although the retractive forces of the two filaments do differ appreciably. This highly desirable characteristic greatly reduces variable stitch formation in fabrics and significantly simplifies the spinning process: Precise flow control of the polymeric components is a major problem in any continuous filament conjugate spinning process; small fluctuations in flow inevitably occur due to minor temperature variations in the metering pumps or slight inhomogeneities in the molten polymer. Filaments of the invention, however, can tolerate appreciable variations in polymer flow without causing an objectionable change in % Bulk so long as the polyurethane component is at or above the level of 30% of the spun filament cross section.

A tentative but reasonable explanation of the constancy of bulk is thought to be as follows: The length of "S" of a right circular helix is given by the formula $$S = N\sqrt{\eta^2 D^2 + P^2} \qquad \text{(Equation 3)}$$

$$L = nP \qquad \text{(Equation 4)}$$

where D and P have the meanings previously stated (FIG. 2), $n$ = the number of turns in the helix, and L = axial length of the helix.

A small length of spun filament is drawn at a draw ratio of, say, 3.5:1 and the drawn length is allowed to contract some 4–6%, which represents the elastic recovery of the polyamide component. The filament is now straight and of length S. As the filament is allowed to contract farther, the polyurethane component is still stretched within its elastic recovery limit, but the polyamide component of length S must bend to conform to this contraction. Because the composition and size of the filament is substantially uniform, segments of the filament bend into circular arcs. Each complete turn or loop about the axis of the helix requires the filament to rotate 360° about its own axis, this rotation being resisted by an oppositely directed torque in an adjoining segment, which in turn develops another coil of the helix to relieve torsional stresses due to this torque. Since the ends of the filament are not free to rotate, each clockwise rotation in one segment generates a counterclockwise rotation in an adjoining segment which then forms a helix of opposite hand relieved by dislocations between the reversed helices.

The minimum radius through which a circular rod may be bent without fracture or permanent distortion is dependent upon the bending modulus of the cross section which, for a given material, increases as the square of the area of the section. The bending modulus of filaments of the invention is dependent upon the proportions of the two components and the size of the filament. The initial contractile force under extension, however, is approximately proportional to the fraction of polyurethane component. 30% of the cross section appears to be about the minimum fraction of polyurethane that provides contractile force just sufficient to bend the filament about its minimum radius and into the close helix configuration.

When a given spun filament of the invention is drawn, the extended length, the denier or size and, hence, the bending modulus are all determined by the draw-ratio. The extended length is equivalent to length "C" in Equation 1, and is also the coiled length of the helix "S" in Equation 3. Upon release, the filament contracts into a series of close helices of diameter "D" that is limited by the fixed bending modulus, with lead "P" at its smallest possible value consistent with "D" and filament diameter "d". The helices therefore contract to a relatively definite minimal axial length "L" which together with the axial lengths of the dislocations is equivalent to "B" in Equation 1; consequently, the % Bulk of freshly drawn filaments has a consistently definite value.

The standard determination of % Bulk requires exposure of the filaments to boiling water, and this treatment causes a net shrinkage in the straightened length of the filaments. In contract with filaments whose crimp is generated by differential shrinkage, filaments of the invention lose a small degree of crimp during the shrinkage treatment, this loss being highly consistent. When freshly drawn filaments with the close helix configuration and stored machine-drawn filaments with open helix configuration are exposed to boiling water, the two samples become indistinguishable after being dried. The close helix "unwinds" slightly and the loose open helix "winds up", both samples finally differing the same extent from the equilibrium close helix. Shifting of the coils and release of stresses at the dislocations permits some distortion in the configuration of the filaments. The helices are no longer perfectly cylindrical, but diameter "D" and lead "P" always change proportionately to yield substantially constant values of % Bulk.

Filaments according to the invention may be produced with conventional conjugate spinning equipment. The two polymeric components may be melted and supplied to the metering pumps by a grid-melter as disclosed by Le Grand in U.S. Pat. No. 3,197,813. Screw extruder-melters are preferable, however, because of more positive control of polymer flow. In the examples cited below, electrically heated, standard $1\frac{1}{2}$ inch screw extruders were used to deliver each polymer melt to the metering pumps at the spinning head.

The spinning head consisted of a conventional Dowtherm-jacketed steel block having a pump pad with two inlet ports for standard Zenith gear pumps that metered separate streams to the integral spinneret pack cavity. A spinneret assembly as disclosed by Kiser in U.S. Pat. No. 3,166,788 was used in which the two polymer streams came together just upstream of the capillary orifices at the spinneret face.

Cooling air was blown across the extruding filaments as they passed vertically down a conventional quenching chimney to a comb-type convergence guide. The filaments were passed over a suitable finish applicator roll to a feed roll and thence to a surface-driven windup bobbin. Any tendency of the filaments to stick together was effectively reduced by the application of an appropriate liquid finish. One suitable finish is a 10% solution of Union Carbide L-530 organo-silicone copolymer, manufactured by Union Carbide Corp., Silicones Division, 270 Park Avenue, New York, N.Y.; this finish was applied at a concentration of 3–5% organo-silicone on the filaments.

The spun conjugate filaments may be drawn on conventional drawtwisters and drawwinders. In the examples filaments were drawn on a standard drawtwister. Several drawtwisting positions were equipped with heated air tubes through which the filaments could be passed immediately below the draw zone prior to windup.

EXAMPLE 1

A polyurethane was made by reacting together a mixture of 100 parts by weight of a hydroxy-terminated polyester having a molecular weight of about 2000 prepared from 1,4 butylene glycol and adipic acid having hydroxyl number of 55 and acid number 1.5, 9 parts 1,4 butanediol, and 40 parts of 4,4'-diphenylmethane diisocyanate. The intimate mixture of reactants was prepared at 100° C., cast upon heated trays and cured at 130° C. for ten minutes into a solid mass that was subsequently chopped into flakes with a rotary cutter. The specific viscosity was 0.72, measured as a 0.4% solution of polyurethane in dimethyl acetamide containing 0.4% of lithium chloride at 25° C. A finely divided representative sample had a melting point of about 185° C. determined by DTA.

The polyester-urethane chips were then charged to the feed hopper of one extruder-melter and commercial nylon 6 pellets having a relative viscosity of 24 were charged to the other. The metering pump speeds were set to deliver the two melts in the ratio of 1:1 by volume at a spinning speed of 300 y.p.m. Process temperatures were varied widely and the spinning speed was reduced to as low as 100 y.p.m. but under all conditions the polyurethane component was too tacky to permit more than a few hundred successive yards of yarn to be spun, and none of the yarn could be unwound from the bobbin.

Nylon 12 having m-cresol relative viscosity of 1.4 was substituted for the nylon 6 and the spinning temperature was varied widely, but no operable conditions could be found. Even filaments collected by free extrusion without being wound up were weak and sticky.

EXAMPLE 2

The procedure outlined in Example 1 was followed except that the diisocyanate was reduced to 30 parts by weight and the 1,4-butanediol was replaced with approximately 14 parts by weight of 1,4-bis-($\beta$-hydroxyethoxy)benzene. The polyurethane thus obtained had a DTA melting point of about 180° C. This polyurethane also was too sticky to spin satisfactorily in conjugate filaments with either nylon 6 or nylon 12. Freely extruded filaments when hand-drawn are self-crimping but extremely weak as well as tacky.

EXAMPLE 3

A polyurethane was prepared according to the procedure of Example 1 using 100 parts by weight of a polyester from 1,4-butanediol and adipic acid, hydroxyl number 53 and acid number 1.5, 60 parts by weight of 4,4'-diphenylmethane diisocyanate, and about 38 parts by weight of 1,4-bis-($\beta$-hydroxyethoxy)benzene, the reactants being exactly chosen such that there was 1.03 isocyanate groups for each 1.0 hydroxy group. The polyurethane so obtained had a melting point by DTA of about 225° C.

The polyurethane chips and nylon 6 pellets with relative viscosity of 24 were charged to their respective extruders. Spinning proceeded quite smoothly with essentially no tackiness in the conjugate filaments. As they were spun the filaments were wound up separately as monofilaments on a pair of surface-driven bobbins, five cakes per bobbin. A large number of full-sized spin cakes were collected for subsequent treatment. Principal spinning conditions were:

| | |
|---|---|
| Melt-Extruder Outlet Temperature, | |
| Nylon 6 | 253° C |
| Polyurethane | 218° C |
| Spinning Block Temperature | 225° C |
| Nylon 6 / Polyurethane Ratio (by volume) | 1:1 |
| Capillary Orifice Diameter | 25 mils |
| Spinning Speed | 300 y.p.m. |
| Spun Denier per Filament | 105 |
| % Finish on Yarn | 3.5 |

Upon being hand-drawn and released, spun filaments would immediately contract into closed helical coils. Two monofilament skeins were wound on a denier reel carefully to avoid predrawing. One skein was placed in boiling water for 5 minutes and the other was exposed 10 minutes to a standard anthroquinone blue dye bath at the boil. After being dried and conditioned, the two undrawn skeins were measured and found to have shrunk equally about 2.5%, but the filaments remained straight and uncrimped. The nylon 6 was of uniform medium blue color in the dyed filament but the polyurethane component was uncolored and translucent. The relative positions of the two components could easily be seen with a 10X magnifier due to the color difference. Subsequent tests showed that the polyurethane component in general was undyeable by any of the standard acid dye baths used for nylons.

When hand-drawn 300–400%, the preshrunk spun filaments immediately contracted into a series of close helices as illustrated in FIG. 3, the dyed filaments clearly showing the blue nylon on the outside of the helix. Viewed at 125× magnification, the cross section of a filament appeared similar to FIG. 1 B except that the interface 4 was slightly convex toward the polyurethane side. Within the error of measurement, the spun filament cross section was comprised of 50% each of nylon 6 and polyurethane; because of the greater density of the solid polyurethane compared with that of nylon 6 (1.25 cf. 1.14 gm/cm$^3$) the filament was about 55% polyurethane by weight.

A length of undrawn filament was carefully clamped in the jaws of a standard Instron Tensile Tester with jaw separation and filament length of 5 cm. The filament was stretched 450% at the rate of 50 cm/min.; then the jaws were immediately brought together at the same rate while the filament was observed with a low-power hand magnifier. The filament was still straight when the jaws were 21.3 cm. apart or the filament had contracted about 4.5%. As the jaws closed farther, helices began to develop, becoming progressively tighter with some segments winding clockwise and others counterclockwise. At less than 3 cm. jaw separation the close helically crimped filament became slack. Re-extension showed that the crimped filament was again completely straight when jaw separation was about 21.3 cm. On the basis of these straight and coiled lengths the single filament had about 90% bulk. A similar segment of filament was hand-drawn about 450%. The Instron-drawn and hand-drawn samples were allowed to lie unconstrained on a laboratory table for an hour and were then examined with a 50× hand microscope having a reticle calibrated in mils. Simple hand-drawing was concluded to be an adequate means of rapidly checking the self-crimping of spun filaments.

Comparative dimensional measurements expressed in mils are given in the Table II:

Table II

| | Instron-Drawn | Hand-Drawn |
|---|---|---|
| D, helix dia. | 7.2 | 6.0 |
| P, Lead of helix | 3.0 | 2.5 |
| d, dia. of filament | 2 | 2 |
| Coils per inch, ( $\frac{1000}{P}$ ) | 330 | 400 |

EXAMPLE 4

The spinning run outlined in Example 3 was continued except that the proportion of nylon 6 to polyurethane was varied by changing the relative speeds of the metering pumps; only minor compensating changes in spinning block temperature were required. Several full size spincakes each were collected of filaments containing 25%, 35%, and 65% polyurethane. Each of the latter two filaments contracted into close helical coils when handdrawn. Filaments containing 25% polyurethane contracted into a loose open helix somewhat as illustrated in FIG. 2.

These spincakes and those produced in Example 3 were stocked on a standard drawtwister operated at a machine draw ratio of 4.05 and with a yarn speed of 585 y.p.m. Each filament made one 360° wrap around a standard $\frac{3}{8}$ inch drawpin that tended to localize the draw zone. At several drawtwister positions the filament leaving the draw roll was passed axially through a heated stainless steel tube 9 inches long by $\frac{1}{2}$ inch diameter into which preheated air was passed cocurrent with the moving filament. The air temperature was controlled at 140° C. and the filament was wound up at 35% underdrive; that is, the filament emerged from the tube at 35% lower speed than it entered. This reheated yarn is referred to as "prebulked".

Several skeins of each item of freshly drawn yarn were unwound from the bobbins in preparation for subsequent checks of shrinkage and % bulk. Except for those containing 25% polyurethane, the filaments in the loose skeins slowly contracted into close helices after about 30 minutes. The "prebulked" samples, however, contracted much more slowly and acquired only a loose open helical form after several hours. All of these skeins were exposed to boiling water and conditioned as previously mentioned for shrinkage and bulk measurements. After boiling, the skeins appeared much alike. All filaments had a slightly open and somewhat irregular helical configuration. After the drawn yarn bobbins had been in storage six weeks, new skeins of each item were unwound and rechecked for shrinkage and bulk. There was no significant change in either the physical appearance or the bulk and shrinkage after this period. Representative data are given in Table III below.

Table III

| % Polyurethane | Drawn | | Drawn and Prebulked | |
|---|---|---|---|---|
| | % Bulk | % Shrinkage | % Bulk | % Shrinkage |
| 25% | 55.0 | 19.0 | — | — |
| 35% | 71.8 | 17.8 | 58.0 | 8.0 |
| 50% | 63.0 | 16.7 | 61.4 | 9.2 |
| 65% | 74.8 | 17.8 | 74.0 | 10.8 |

The data in Table III indicated that shrinkage of the drawn conjugate filaments is somewhat higher than for a homofilament of nylon 6 and that the "prebulking" heat treatment reduces the shrinkage appreciably but has much less effect upon the % bulk. Some of these bobbins were re-examined after being stored 19 months; the filament characteristics had not changed appreciably; the drawn 35% polyurethane filaments, for example, still had 67.0% bulk and 16.3% shrinkage.

EXAMPLE 5

Three of the drawn conjugate yarn samples produced in Example 4 were knitted into tubing on a circular knitter, the same machine settings being used for each item. These knitted tubes were then dyed in a "blank" dye bath; that is, a standard dyebath except that the dye was omitted.

After being dried, the "dyed" and finished tubes were compared with the greige tubes. The stitches of the dyed "prebulked" samples had tightened up quite similarly to those of standard nylon yarns. The samples that were drawn but not prebulked had a tighter stitch due to the higher degree of shrinkage of the filaments, as previously indicated in Table III. It was evident that equally open stitch finished fabric could be produced with either the prebulked yarn or the drawn yarn, provided the stitch in the greige fabrics were adjusted to compensate for the differences in shrinkage. There are practical limitations upon the stitch adjustments of a given knitting machine, however. Therefore, for many fabrics the drawn yarn may be used directly while for other fabrics the post-heated or prebulked yarn is preferable.

Ladies hosiery samples were knitted in a standard seamless construction on a Booton, 400 needle, two-feed knitting machine. Hose were knitted of commercial 15-denier nylon yarn, and of the conjugate filaments containing 35% and 65% polyurethane. The stitch was set to provide commercial size 9½ hose, the stitches being adjusted to allow for shrinkage differences of the greige fabrics. The greige hose were dyed following standard procedures with Glycoluce Blue BN new, and with Glycoluce Scarlet and Glycoluce Yellow G dyes supplied by the Geigy Co.; the hose were finally boarded on standard size 9½ forms at 230° F. for one minute.

The polyurethane component remained undyed and virtually transparent although this was not evident without lower power magnification, the hose appearing very uniformly colored to the naked eye. Several dozens of pairs of hose were distributed for actual wear testing. The test hose appeared very sheer on the human leg. Although of nominal 26 denier, the conjugate yarns actually seemed less visible than standard 15 denier nylon. Close examination with a 10× magnifier of the hose on the human leg suggested that the polyurethane component was virtually invisible because the "flesh-colored" light reflected from the leg tended to be transmitted through and along the transparent polyurethane component. This explanation was supported by the observation that hose containing 65% polyurethane filament appeared most sheer. The wearers reported that the test hose were very comfortable. These hose continued to provide desirable "snug support" and excellent ankle and knee fit after many launderings and re-wearings over a period of several months.

Many existing quantitative tests of the tensile characteristics of hosiery yarns do not correlate well with performance of hosiery made from the yarn during actual wear tests. The following test procedures were therefore devised, wherein the hose were subjected to stresses and strains similar to those occurring during wear tests.

THE PREDETERMINED EXTENSION TEST

Figure 6:
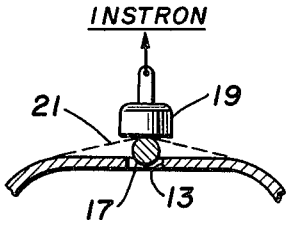
FIG. 6 is a schematic representation of a section taken along line VI—VI of FIG. 5, including additional mechanical elements used in the testing procedure.
Figure 5:
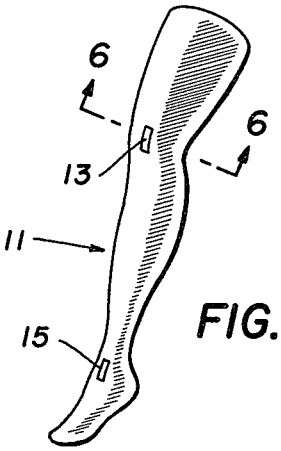
FIG. 5 illustrates schematically an arrangement used to check the stretch recovery characteristic of ladies hosiery.

In FIGS. 5 and 6, mannequin leg form 11 is used to hold the stocking being tested. A slot about 1 inch long by ¼ inch wide is cut through the wall of the hollow plastic leg form at the knee 13 and at the ankle 15. An armature 17 made of magnetic material ¼ inch diameter by one inch length, and a permanent magnet 19 with a hook eyelet comprises the remainder of the special apparatus. The armature may be made of type 430 stainless steel with all burrs and edges smoothed over; the permanent magnet may be a small alnico horseshoe magnet, but a stack of flat ceramic magnets with a carbon steel shell to localize the flux of the two poles is preferable.

The predetermined extension test procedure is as follows: The stocking is drawn over the leg form and smoothed as it would be on the natural human leg and the welt is clamped in position by a heavy rubber band. The armature 17 (FIG. 6) is placed in slot 13 from inside the leg form; on the outside magnet 19 is brought up to the armature which is attracted and held by the pole pieces of the magnet without pinching or folding the fabric back upon itself; the armature shifts freely as necessary to balance small inequalities in the lateral forces applied to the fabric. Magnet 19 is now attached to the load cell, and the leg form, positioned almost horizontally, is clamped to the cross-head of an Instron Tensile Tester. The Instron draws the magnet-armature and leg form apart, stretching the hosiery away from the leg form as indicated by dashed line 21 in FIG. 6. Experimentation showed that realistic reproducible simulation of the severe stresses that occur at the knee and ankle is attained when the magnet-armature moves one half inch outward in 7.6 seconds, is held at this position 5 minutes, and is then moved back to the zero position in 7.6 seconds. The half-inch outward movement causes about one inch of stretching around the circumference of the hose. The applied force is sensed by the load cell and is recorded on a standard Instron chart with zero extension when the magnet-armature is flush with the leg-form surface, and with 100% extension or stretch when the magnet-armature has moved outward one-half inch.

Figure 7:
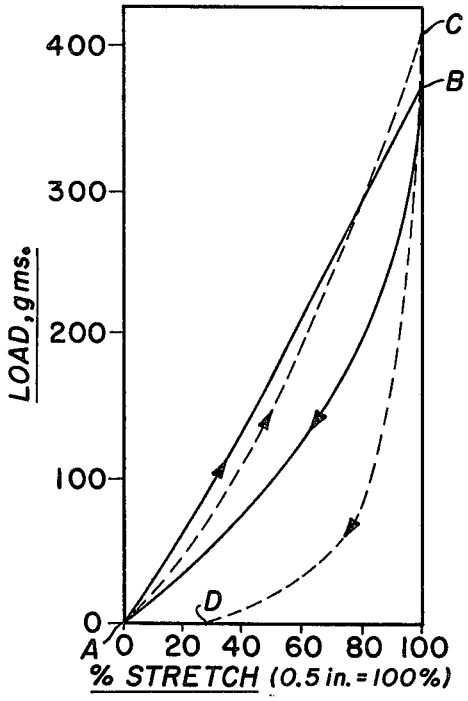
FIG. 7 is a graph illustrating the typical form of stress-strain curves in stretch recovery tests of ladies hosiery by the method illustrated in FIGS. 5 and 6.

FIG. 7 shows load-elongation curves of hosiery tested by the above procedure. The solid curve was taken with hosiery made of filaments according to the invention, and the dashed curve is typical of hosiery made of standard commercial nonstretch nylon hosiery yarn. Curve branches AB and AC represent variation of load as the magnet-armature moves outward one half inch, and are referred to as a "loading curve". Branches BA and CDA are referred to as an "unloading curve", which correspondingly represent the load as the magnet-armature moves back to the zero position.

Besides graphic display, several useful numerical indices of hosiery stretch characteristics may be taken from the loading and unloading curves. When putting on and taking off stockings, kneeling, crossing the legs, flexing the ankles, etc., the hose is locally stretched considerably and held for a period of time. The excellence of fit, feeling of comfort, smoothness, support, etc. depend not only upon the degree to which the hosiery may be stretched but, more importantly, upon the extent to which the hosiery will retract after being stretched and the residual force after retraction. For example, the hose will bag around the ankle if the contractile force drops to zero before the hose actually contracts back to the size of the ankle. Similarly, the hosiery will not provide significant support if the contractile force becomes negligible as the hose contracts to the leg size. It is not of primary importance, however, whether or not the hose always contracts back to its original unconfined size, since all standard hose are worn in a stretched condition. From such considerations the following practical numerical factors may be defined.

(1) The "Bag Level" is the load in grams when the hose has recovered 85% of the full stretch, or is the load at 15% stretch on the unloading curve.

(2) The "Power Level" is the load in grams when the hose has recovered 50% of the full stretch, or is the load at 50% stretch on the unloading curve.

(3) The "Power Decay" is the percentage by which the load at 50% stretch on the unloading curve differs from the load at 50% stretch on the loading curve.

(4) The "Peak Level" is the load in grams at 100% stretch after the 5 minute hold period.

(5) The "Peak Decay" is the percentage the initial maximum load dropped during the 5 minute interval to reach the peak level.

The dashed curves ACDA in FIG. 7, for example, indicate a Bag Level of 0, a Power Level of about 15, a power decay of about 89%, and a Peak Level of about 260 with Peak Decay of about 39%. Such hose would be expected to provide little support and to bag after a few wearings. Conversely, the hosiery characterized by curve ABA would be expected to provide excellent fit and support. Such conclusions accord with the results of actual wear tests.

Size 9½ standard commercial hosiery of several varieties were purchased and compared with finished test hose. The items were coded as follows:

Item A: Commercial sheer nonstretch hose made of nominal 15-denier nylon 66 monofilaments.

Item B: Commercial sheer stretch hose, a brand usually regarded as the top quality hose of this type, made of conjugate 20 denier filaments. Presumably these filaments are a combination of nylon 66 and a copolyamide in which helical crimp is developed by differential shrinkage of the two components.

Item C: Commercial sheer stretch hose made of nominal 20 denier nylon 66 monofilament that is helically crimped by heat and a mechanical deformation treatment.

Item D: Commercial sheer support hose, one of the top quality brands in this category. Core-spun filaments in this hosiery was estimated to about the size of a 45–50 denier nylon monofilament and appeared to be comprised of a 40 denier spandex filament wrapped with two 15 denier nylon filaments. Although designated as "sheer", these hose were extremely coarse-appearing in comparison with the other items, and could be described literally as "sheer" only in comparison with heavy surgical support hose.

Item E: Test hose of filaments of Example 5 herein, containing 35% polyurethane, and prebulked.

Item F: Test hose of filaments of Example 5 herein, containing 50% polyurethane, not prebulked.

Item G: Test hose of filaments of Example 5 herein, containing 65% polyurethane, and prebulked.

Item H: Test hose of filaments of Example 5 herein, containing 65% polyurethane, not prebulked.

All of these hosiery items were submitted to the previously described stretch and recovery test at the knee and ankle, three hose per item. Reproducibility of the measurements was excellent; average values were used to characterize each item as shown in Table III:

Table III

| Item | A | B | C | D | E | F | G | H |
|---|---|---|---|---|---|---|---|---|
| Bag Level | | | | | | | | |
| Knee | 0.0 | 1.0 | 5.3 | 7.3 | 16 | 20 | 22 | 26 |
| Ankle | 0.0 | 1.0 | 0.0 | 6.0 | 3.0 | 10 | 22 | 15 |
| Power Level | | | | | | | | |
| Knee | 14 | 20 | 26 | 50 | 83 | 84 | 82 | 99 |
| Ankle | 1.3 | 12 | 4.0 | 38 | 33 | 50 | 86 | 64 |
| Power Decay, | | | | | | | | |
| Knee | 90% | 80% | 74% | 75% | 60% | 52% | 49% | 44% |
| Ankle | 92% | 76% | 73% | 70% | 71% | 58% | 46% | 47% |
| Peak Level, | | | | | | | | |
| Knee | 289 | 185 | 180 | 441 | 364 | 318 | 295 | 317 |
| Ankle | 122 | 104 | 33 | 333 | 204 | 207 | 295 | 240 |
| Peak Decay, | | | | | | | | |
| Knee | 30% | 26% | 27% | 25% | 20% | 18% | 15% | 16% |
| Ankle | 36% | 29% | 28% | 27% | 24% | 20% | 16% | 16% |

Bag Level, Power Level, and Power Decay are regarded as the more indicative indices of hosiery performance. Comparison of data in Table III for test hosiery items E–H and standard commercial items A–D reveals distinct superiority of the test hosiery. This superiority cannot be reasonably explained by denier differences of the filaments in the various hose, particularly the permanence of contractile force as indicated by Power Decay and Peak Decay. The data also indicate that prebulked filaments provide a somewhat greater degree of uniformity in the hosiery than nonprebulked filaments, as shown by comparison of indices at the knee and ankle (e.g., Item G cf. Item H).

The most surprising feature of the data in Table III is the pronounced superiority of indices of test hosiery items F–H compared with those of Item D, a commercial support hose. The bag and power levels are much higher even though the size of the elastomeric polyurethane component in the test hose is less than one half the size of the spandex core in the filaments of the commercial hose. As previously noted, the test hose were sheer as regular hose while the commercial hose Item D was very coarse-appearing. It is evident that even smaller filaments of the invention could be used to make hose that would provide as much support as the commercial hose Item D, while being even more sheer. A slightly larger filament according to the invention would be usable directly in surgical support hose and still be sufficiently sheer for dress wear.

Figure 4:
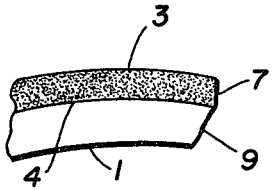
FIG. 4 is a lateral view of the end of a segment of filament that is cut through a plane normal to the axis of the filament.

A freshly drawn 50% polyurethane filament was straightened and cut straight across the axis with a razor blade; this cut is illustrated in FIG. 4. The cut face of nylon 7 was practically straight but face 9 of polyurethane retracted as shown. Typical filaments of the invention have a helix diameter "D" of 6–8 mils and a filament diameter "d" of 2–3 mils; this means that the circumference of the outside 3 of a loop of the helix may be 30–40% greater than the inside circumference 1; at the interface 4 both components, nylon and polyurethane, have the same length as the straightened filament. While crimped, therefore, nylon at 3 is strained 10–20% and must bear a tensile load and at interface 4 is compressed a similar amount and must bear a compressive load; the polyurethane is under maximum tensile load at interface 4 and a lesser load on the inside at 1. When the filament is actually straight both components bear tensile loads proportional to their cross sectional areas and respective tensile modulus at the given strain.

A finished hose spread between a pair of hard cover books was rolled back and forth about 50–75 times with moderate pressure. Unravelled filaments from this portion of the hose could then be split into component subfilaments. A 4-inch length of this knit-deknit filament was carefully split apart and the two component subfilament laid unconstrained on a flat surface. According to the load-bearing component viewpoint the polyurethane component would be expected to lie straight and contract appreciably and the nylon subfilament would be expected to lie straight and extend appreciably. Actually both subfilaments retained the same characteristic irregular helical crimp and superimposed stitch loops of the composite filament; by simple hand test it appeared that the force required to straighten out the crimps was greater for the nylon than for the polyurethane, and each subfilament quickly recovered its crimp when the force was removed. It is clear that as they exist in the finished fabric, filaments according to the invention have no specific load-bearing component, both components bearing part of the applied load and perhaps thereby providing the superior contractile properties indicated in Table III.

In the finished knitted fabric of hose the filaments are stretched into a widely open helix with the stitch loops superimposed. As previously mentioned, because of rotation of the filament about its axis a helix cannot be restored to its originally straight condition simply by applying tension to the ends of the coils; the helix must actually be unwound, or the interface between components, for example, will remain like a twisted ribbon even though the filament is ostensibly straight. This torsional stress probably contributes to the superior contractile properties of hosiery according to the invention: Stitch loops in the wales and courses are thought to trap many of the dislocations between reversed helical segments so that filaments in loops cannot become truly straightened as the hose is stretched.

EXAMPLE 6

The procedure outlined in Example 1 is followed using 100 parts by weight of polyester prepared from 1,4 butylene glycol and adipic acid and having a molecular weight of about 2000, hydroxyl number 55, and acid number 1.5; 90 parts by weight of 4,4'-diphenylmethane diisocyanate; and about 27 parts by weight of 1,4-butanediol, the exact ratio being chosen to give an NCO/OH ratio of 1.02. The resulting blended polyurethane chips have a DTA melting point of about 220° C. and a specific viscosity of 1.19. Filaments are readily spun conjugately under the conditions set forth in Example 3 with nylon 6 having relative viscosity of 28 and with nylon 610 having a relative viscosity of 14 in 85% phenol solution. The conjugate yarns process readily without objectionable sticking. Yarn properties of both types of filaments are quite comparable to those of filaments produced in Example 3.

This Example illustrates the effect of increasing the amount of diisocyanate content in producing the polyurethane polymer. Example 1 shows that using 3.2 mols of diisocyanate per mol of high molecular weight diol (polyester) is unsatisfactory. Example 3 shows that using 4.8 mols of diisocyanate per mol of polyester produced a polyurethane melt spinnable conjugately with a hard fiber: the practical lower limit is about 4.4. Presumably due to minor amounts of impurities in the raw materials, it is sometimes difficult to produce polyurethanes with consistently high enough viscosity at the desired spinning temperature to properly match the viscosity of the hard or non-elastomeric polymer. These difficulties are much less evident when using at least 5.2, and preferably 5.6 or more mols diisocyanate per mol of the high molecular weight diol. The polyurethane of this Example provides high viscosity polymer much more consistently than does that in Example 3, and accordingly provides more consistent spinning performance and better control of the shape of the interface between the hard fiber and the polyurethane. Of course in all cases it is necessary to adjust the amount of the low molecular weight diol to maintain the NCO/OH ratio between 1.01 and 1.04.

EXAMPLE 7

One employs 100 parts by weight of polyester prepared from 1,4-butanediol and adipic acid. The polyester has a molecular weight of about 2000, a hydroxyl number of 55, and an acid number of 1.5. To the polyester are to be added 60 parts by weight of 4,4'-diphenylmethane diisocyanate and sufficient 1,4-butanediol (chain extender) to provide an NCO/OH ratio of 1.02. The 1,4-butanediol and polyester are blended together at 100° C. The 4,4'-diphenylmethane diisocyanate, also heated to 100° C., is then added. The resulting mixture is then vigorously stirred for about one minute to insure thorough blending of the three ingredients. The blended reaction mixture is then cast on a flat surface in an oven heated to 130° C. The reaction mixture solidifies to a low molecular weight polyurethane polymer in about 2–3 minutes. The solid polyurethane polymer is kept in the heated oven for another 5–6 minutes to increase the molecular weight, and is then removed and cooled to room temperature. The resulting polymer slab is then chopped into flake of the desired size. The flake is then stored under an inert (nitrogen) atmosphere at less than 50° C., for example at room temperature, for at least 5 (preferably at least 20) days before spinning. The storage step improves spinning performance and reduces tackiness of the filaments, whether the polyurethane is melt-spun alone or conjugately with a hard fiber. The reason for the improvement in spinning performance provided by the storage step is believed to be chain-extending polymerization in the solid state. Accelerated curing at higher temperatures is possible, but is believed to form increased amounts of undesirable cross-linking by formation of allophanate and biuret linkages. The biuret linkages occur to some finite though small extent due to the virtually unavoidable presence of trace amounts of water in the polyester and in the chain extender. The allophanate and biuret linkages are believed to be unstable above 200° C., and thus present no particular problem in melt spinning. However, their formation prevents attaining the desired maximum chain extension, by removal of unreacted isocyanate groups necessary for chain extension.

The resulting polyurethane flake having a DTA melt point of 215° C. is spun conjugately with nylon 6 having a relative viscosity of 28, under the spinning conditions set forth in Example 3. By adjusting the meter pump speeds, the denier and the ratio of polyurethane to nylon is varied as noted below. The spun yarn is cold drawn on a draw-twister at a draw ratio of 4.05. The drawn yarn is knitted into ladies seamless sheer hose on a Booton 400 needle two-feed knitting machine. The hose were acid dyed at 95° C., boarded at 115° C., and tested as follows.

THE PREDETERMINED LOAD TEST

Figure 8:
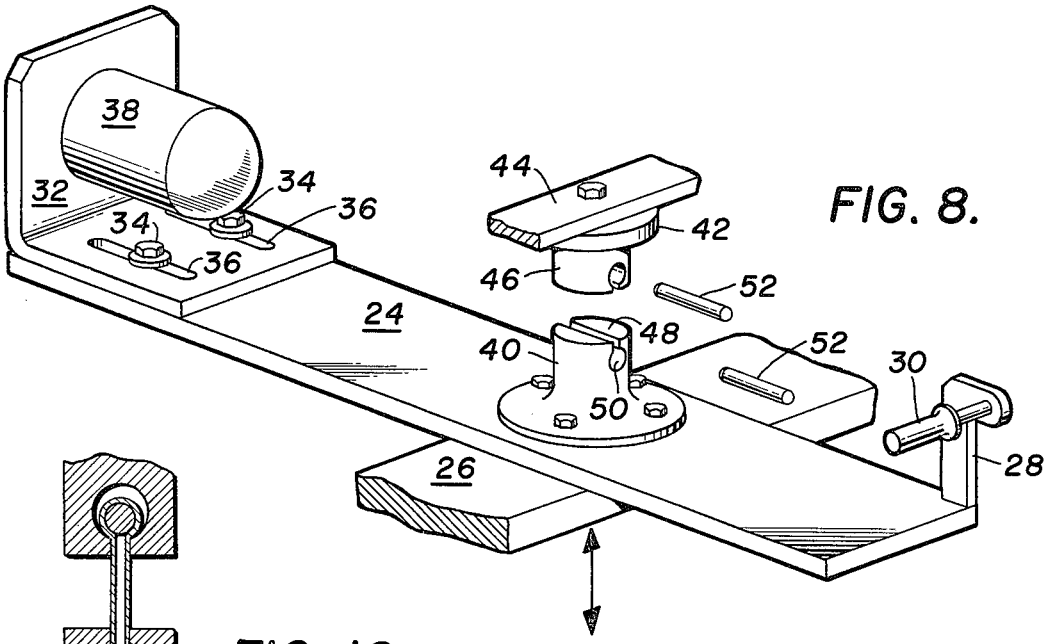
FIG. 8 is a perspective view of a further form of test apparatus.
Figure 10:
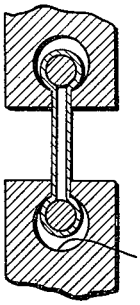
FIG. 10 is a sectional view taken along line 10—10 in FIG. 9.
Figure 9:
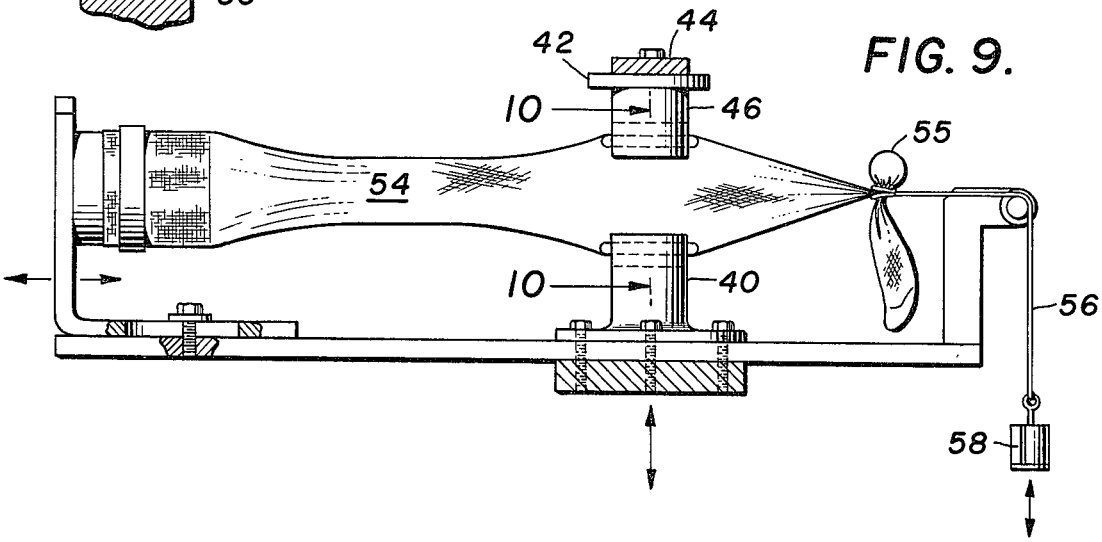
FIG. 9 is a side elevation view, partly in section, of the FIG. 8 apparatus, showing a hose arranged for testing.

The apparatus for the predetermined load hosiery test is illustrated in FIGS. 8–10. The apparatus includes a rigid axially elongated plate 24 horizontally mounted on crosshead 26 of a floor model Instron Tensile Tester. Upstanding bracket 28 is mounted at one end of plate 24, and supports freely rotatable idler roll or pulley 30. The upper surface of roll 30 is 125 mm. above the upper surface of plate 24, and the axis of roll 30 is horizontal. An L-shaped bracket 32 is mounted at the opposite end of plate 24 by bolts 34. Slots 36 permit adjustment of bracekt 32 in the direction of the axis of plate 24. A right circular cylinder 38 having an outside diameter of 127 mm. is mounted on the upstanding portion of bracket 32, the axis of cylinder 38 being horizontal and tangent to the upper surface of roll 30. Vertical support 40 is mounted on plate 24.

The Instron load cell 42 is mounted on fixed frame member 44. Depending support 46 is suspended from load cell 42, and has its vertical axis coaxial with the axis of support 40. The distance from the axes of supports 40 and 46 to the axis of roll 30 is 635 mm.

The opposed surfaces of supports 40 and 46 define horizontal planes. The upper surface 48 of support 40 is 107 mm. above the upper surface of plate 24. At least the upper 30 mm. of support 40 is right circularly cylindrical about the axis of support 40, the cylinder having a diameter of 50 mm.

As shown in FIGS. 8 and 10, horizontal right circularly cylindrical bore 50 extends entirely through support 40 along an axis parallel to the axis of cylinder 38. The axis of bore 50 is 10 mm. below upper surface 48, and the bore diameter is 14.5 mm. A vertical slot is provided through upper surface 48 and communicates with bore 50 along the entire length of bore 50. The slot has a uniform width of 4.5 mm., and is parallel with and vertically centered above the axis of bore 50. All edges and corners are rounded sufficiently to prevent cutting or snagging of the hose being tested. The lower 30 mm. of support 46 is identical with the upper 30 mm. of support 40, the adjacent portions of supports 40 and 46 being in effect mirror images of one another. Two pins 52 are also provided, each being 176 mm. long overall, and having a diameter of 12 mm. The ends of each pin are hemispherical, being thus portions of spheres of 12 mm. diameter.

A hose 54 is prepared for testing in the following manner. A spherical ball 55 having a 31 mm. diameter and weighing between 18 and 19 grams is placed in the heel of the hose. One end of a cord 56 is then tied around the hose and snugly against the ball, so that the ball is snugly held in a pocket formed from the heel, as shown in FIG. 9. The other end of cord 56 is attached to 1 kilogram weight 58. Pins 52 are placed in hose 54. With cord 56 resting on roll 30 and weight 58 freely suspended, the remainder of the hose is stretched toward and secured to the outer surface of cylinder 38, as by using double-faced adhesive tape or a strong rubber band. The position of bracket 32 is adjusted as necessary until the free end of cylinder 38 is as near 460 mm. as possible (no less than 310 mm.) from the axis of support 40 when the center of the ball is spaced between 7.5 and 15 mm. from the axis of roll 30. Pins 52 are then manually positioned in the bores in supports 40 and 46, to the positions shown in FIGS. 9 and 10. The hose is then carefully rearranged as necessary so that equal amounts of the hose are disposed on opposite sides of the plane defined by the axes of the bores in supports 40 and 46. The distance between ball 55 and roll 30 is next fixed, as by clamping cord 56 to plate 24 in such a manner as not to disturb the tension in hose 54.

Figure 11:
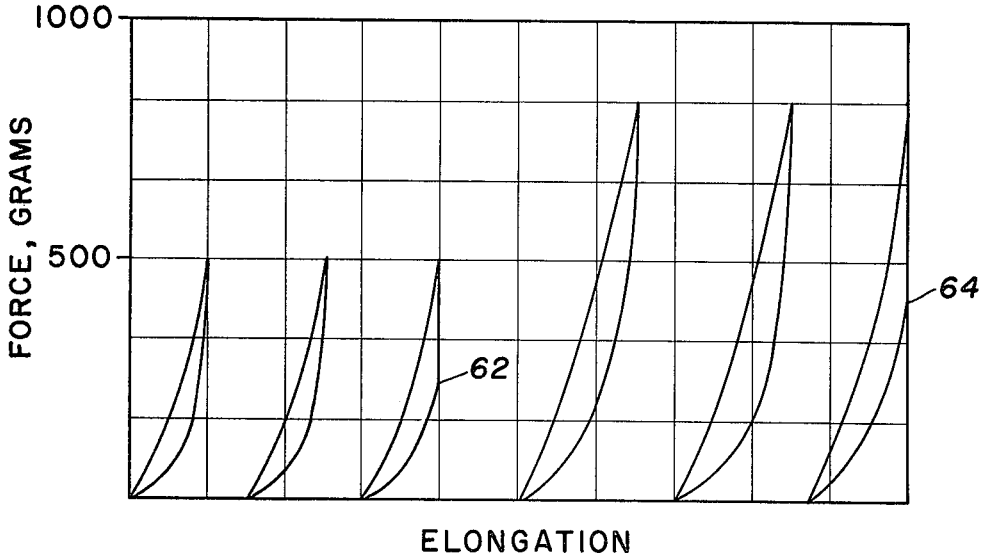
FIG. 11 is a generalized graph of the stress-strain curves recorded during use of the FIGS. 8—10 test apparatus.

The predetermined load test is performed as follows. The Instron tensile tester is set so that crosshead 26 moves at a rate of 50 cm. per minute in both the up and down directions, and the recording chart speed is set at 50 cm. per minute. Crosshead 26 is initially positioned at the reset position wherein the opposed surfaces of supports 40 and 46 are 5 mm. apart. To begin the first cycle, crosshead 26 is lowered until 500 grams force is detected by stationary load cell 42 and recorded on the Instron chart, at which time the direction of crosshead movement is immediately reversed. Return of the crosshead to the reset position completes the first cycle. The chart paper is preferably shifted after each cycle, so that the stress-strain curve of each cycle is separately recorded as shown in FIG. 11. Fifteen seconds after the crosshead returns to the reset position, a second cycle is performed in the same manner as the first. Fifteen seconds after completion of the second cycle, the third cycle begins. The third cycle differs from the first and second cycles in that, when 500 grams force is recorded, the crosshead is stopped and held stationary 5 minutes before being returned to the reset position to complete the third cycle. While the crosshead is stopped, the sensed force drops to some point 62 before the crosshead is again raised. The distance in grams from point 62 to the 500 gram level, divided by 500 grams, gives the five minute set loss as a percentage. Hose produced according to the invention are characterized by a five minute set loss as thus defined of less than 35%, and usually less than 30%. By way of contrast, Item B has a five minute set loss of about 43%. The only other known hose having such low loss are those made of wrapped spandex, with values of 31–39%.

The next three cycles are performed in the same manner as the first three, except that 1000 grams instead of 500 grams load is used as the signal to reverse the crosshead (fourth and fifth cycles) or stop the crosshead (sixth cycle). All other conditions are the same: there is always a 15 second delay between successive cycles (including between the third and fourth cycles), and the crosshead is stopped during the sixth cycle for a 5 minute period beginning when the load reaches 1000 grams.

While the above description specifies 500 gram peak loads for the first three cycles and 1000 peak loads for the last three cycles, the recorded stress-strain curves (FIG. 11) can show recorded peak loads as much as 50 grams higher than the specified values without significantly affecting the test results. Variations within this range are frequently caused by the recording pen overshooting the actual value due to inertia, etc.

Figure 12:
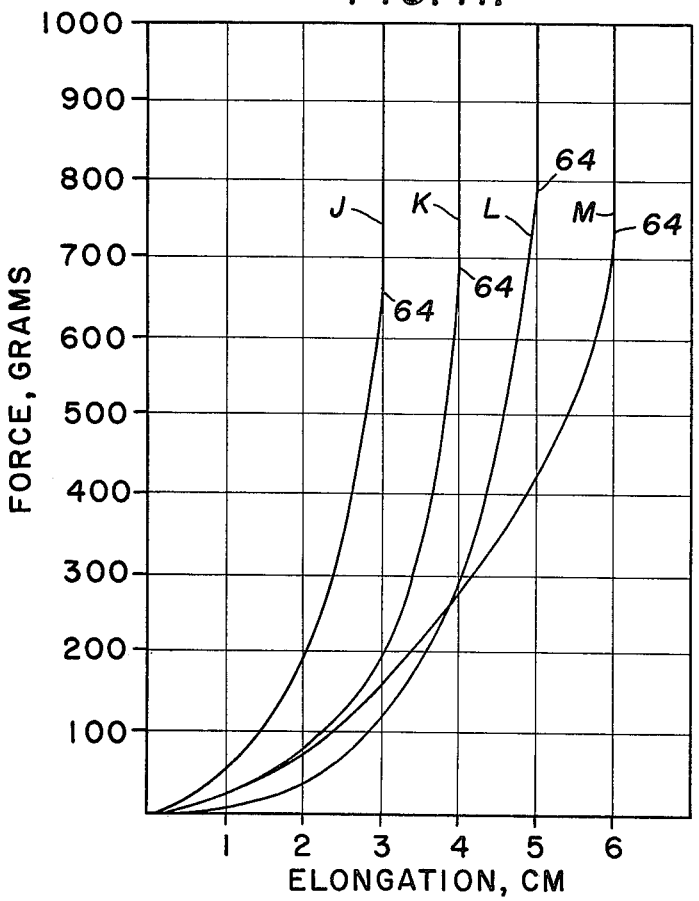
FIG. 12 is a graph of selected curve portions, comparing the hose of the invention with various prior art hose.

The recorded curves will be similar qualitatively to those shown in FIG. 12, which illustrates the unloading curves only for the sixth cycle for several hose. In FIG. 12, curve J represents a premium quality hose knit from false-twist heat-set nylon yarn; curve K represents the same type hose as does Item B (knitted from a conjugate yarn); curve L represents one of the premium quality commercial sheer support hose, and curve M represents an exemplary hose according to the present invention. As is apparent from FIG. 12, the stress-strain curve for item M is considerably less sharply curved than for the other hose. The hose of the invention thus provide a compressive force within a given range (for example, between 100 and 500 grams force) over a much wider range of elongations than do the other hose. This means that the hose of the invention can supply more nearly the same compressive force to a wider range of leg sizes that other known hoses, and thus that fewer sizes need to be knit to accommodate the full range of leg sizes. A further major benefit is that the compressive force on a given leg will remain more nearly constant and uniform as the leg flexes, thus providing greater comfort for the wearer.

The hose of the invention are readily further distinguished from prior art hose by data derived from the sixth cycle unloading curve, as follows. The total elongation S, that is, the crosshead movement in centimeters required to reach 1000 grams load is noted, as is the force of load L in grams on the unloading curve when 50% of the imparted elongation has been recovered (i.e., when the elongation is S/2). The distinguishing parameter, the index of compressive force uniformity (or CFU index), is defined as LS/2. Thus, hose M had a total elongation L of 6.2 cm., and the load L at 3.1 cm. on the unloading curve was 180. The CFU index for hose M is thus $$\frac{(180)\,(6.2)}{2} = 558 \text{ gm. cm.}$$

The corresponding CFU indices for the remaining hose in FIG. 11 are as follows: hose J, 212 gm. cm.; hose K, 174 gm.cm.; and hose L, 218 gm.cm.

The hose of the present invention are characterized by CFU indices above 275 gm.cm. All known prior art hose have CFU indices below this value, no matter how constructed. Values of 330 gm.cm. and above are particularly advantageous. The higher values achieved by the present hose correlate with observed increased comfort for the wearer and observed ability of the hose to properly fit a larger range of leg sizes while providing compressive forces within a given range.

It should be understood that curve M is only one of a family of curves possible according to the invention. The precise curve for a given hose will depend on the yarn denier, the percent polyurethane, the knitted stitch size, boarding temperature, etc. This permits great flexibility in producing hose having predetermined desired properties unattainable with prior art hose.

Table IV gives the average five minute set loss, and CFU index average values for various "sheer support" hose now commercially available.

Table IV

| Item | CFU Index Average | Five Minute Set Loss |
|---|---|---|
| D | 106 | 89% |
| L | 178 | 32% |
| LL | 221 | 31% |

Table V gives 5 minute set loss and CFU index average values for the commercially available conjugate hose shown at K in FIG. 12, followed by ten different hose constructions according to Example 7. These differ in denier, percent polyurethane, and knitted size as indicated.

Table V

| Item | Denier | % Urethane | Knee Size (in) | CFU Index (Avg.) | Five Minute Set Loss (Avg.) |
|---|---|---|---|---|---|
| K | 20 | 0 | 12.5 | 166 | 43 |
| Test N | 20 | 50 | 11 | 330 | 29 |
| Test O | 20 | 50 | 13.5 | 480 | 27 |
| Test P | 20 | 50 | 14.5 | 366 | 32 |
| Test Q | 26 | 50 | 13.5 | 523 | 26 |
| Test R | 26 | 50 | 11 | 330 | 30 |
| Test S | 26 | 50 | 14 | 459 | 27 |
| Test T | 26 | 35 | 14 | 317 | 29 |
| Test U | 26 | 65 | 14 | 449 | 27 |
| Test V | 32 | 50 | 13.5 | 577 | 25 |
| Test W* | 32 | 50 | 11 | 343 | 27 |

*In the last item, only a single hose was tested.

As may be seen from Table V, the leg portion knitted from the disclosed conjugate yarn constitutes means for providing an index of compressive force uniformity of at least 275.

The knee sizes in Table V were determined as follows. Two 3 inch diameter, $\frac{1}{4}$ inch thick steel discs are placed side-by-side with opposed planar surfaces vertical and nearly touching. The hose is slipped over the discs until the discs are in the knee portion of the hose with the hose horizontal. One disc is held stationary while the other disc is moved vertically in its plane by application of a 10 pound force. After five seconds, the distance in inches between the centers of the discs is measured. This distance plus three inches is the knee size. In practice, the stationary disc may be mounted on one end of a fifteen inch horizontal stationary arm lying in the plane of the disc. The movable disc is mounted on one end of a 30 inch arm whose midpoint is pivoted at the other end of the stationary arm. A 10 pound weight is then hung on the opposite end of the pivoted arm. The apparatus thus generally resembles a scissors.

THE AVERAGE MODULUS TEST

Yarn samples were subjected while under a pre-tension of 0.0012 grams per denier to saturated steam at atmospheric pressure for one minute. The samples were then hung while still under the pre-tension for a period of 24 hours in a room maintained at a temperature of 74° F. and 72% relative humidity. Each yarn sample was then tested in the Instron Tensile Tester, model TTC MMI, as follows. One end of the yarn is clamped in the upper clamp of the Instron. The upper edge of the lower Instron clamp was spaced at the reset position 10.0 cm. below the lower edge of the upper clamp. This is, the gauge length was 10.0 centimeters. With the pre-tensioning weight suspended from the lower end of the yarn, the lower clamp was closed on an intermediate portion of the yarn. The Instron was adjusted so that the crosshead speed was 10 cm./min., and the chart speed was 50 cm./min. The crosshead was then lowered until a tension of 0.5 grams per denier was obtained, at which point the crosshead was returned to the reset position at the same speed, i.e., 10 cm./min. On the resulting loading curves of the charts, the gauge or sample lengths are noted where the tension equals 0.1 and 0.5 grams per denier. Results of this test are as follows, with the gauge lengths given in centimeters.

Table VI

| Sample | Denier and % polyurethane | Gauge at 0.1 gpd, cm. | Gauge at 0.5 gpd, cm. | Increase in Gauge, % | Average Modulus |
|---|---|---|---|---|---|
| 1 | 40, 50% | 18.6 | 22.8 | 21 | 1.9 |
| 2 | 15, 50% | 23.0 | 28.2 | 23 | 1.8 |

Table VI-continued

| Sample | Denier and % polyurethane | Gauge at 0.1 gpd, cm. | Gauge at 0.5 gpd, cm. | Increase in Gauge, % | Average Modulus |
|---|---|---|---|---|---|
| 3 | 32, 50% | 30.6 | 37.6 | 23 | 1.7 |
| 4 | 20, 50% | 26.4 | 35.6 | 35 | 1.2 |
| 5 | 32, 60% | 24.8 | 33.2 | 34 | 1.2 |
| 6 | 18, 60% | 29.8 | 38.6 | 29 | 1.4 |
| 7 | 18, 40% | 17.4 | 20.4 | 17 | 2.3 |
| 8 | 28, 65% | 27.8 | 39.4 | 42 | 1.0 |
| 9 | 28, 35% | 15.8 | 17.4 | 11 | 3.7 |
| 10 | 15, 40% | 22.8 | 27.2 | 19 | 2.1 |
| 11 | 26, 50% | 25.2 | 32.6 | 23 | 1.4 |
| 12 | 15, 0% | 12.0 | 12.9 | 7.6 | 5.2 |
| 13 | 15, 0% | 16.5 | 17.3 | 5 | 8.0 |
| 14 | 15, 0% | 13.1 | 13.6 | 4 | 10.0 |
| 15 | 21, 0% | 20.6 | 22.3 | 8.4 | 4.8 |

In Table VI, samples 1–11 were made according to Example 7 herein and cold drawn at a draw ratio of 4.0 prior to the steam treatment. All samples were monofilaments except samples 1, 14 and 15, each of which had 3 filaments. Sample 12 was a 15 denier commercially available polyamide conjugate similar to the yarn in hose K above. Samples 13 and 14 were commercially available edge-crimped polyamide yarns, similar to the yarn in hose C above. Sample 15 was a commercially available false-twist heat-set nylon-66 yarn, similar to the yarn in hose J above.

The average modulus is defined as 100 times the force in grams per denier required to elongate the yarn specimen from a stress of 0.1 grams per denier to a stress of 0.5 grams per denier, divided by the percentage by which the gauge or sample length increases. Since the required force change is 0.4 grams per denier, one thus divides 40 by the percentage gauge increase. For example, the average modulus for sample 1 is calculated by dividing 40 (a constant factor) by 21 (the percentage increase in gauge), to yield the average modulus of 1.9. Yarns according to the invention are characterized by an average modulus less than 3.9, with superior yarns having an average modulus less than 2.5. Particularly preferred are those yarns having an average modulus less than 2.0.

The significance of the low average modulus values achieved according to the invention is that yarns with low average modulus values exert a force within the useful range (0.1 to 0.5 grams per denier) over a greater range of stretching. This means that hose knit from such yarn correspondingly exhibit higher indices of compressive force uniformity, and accordingly provide useful support to a wider range of leg sizes.

EXAMPLE 8

The procedure and recipe in Example 7 is followed except that a polyester from ϵ-caprolactone with hydroxyl number 54 is substituted. The resulting polyurethane has a DTA melting point of about 215°–220° C., and can be melt spun conjugately under the Example 3 conditions quite satisfactorily with nylon 6 without sticking.

EXAMPLE 9

The procedure of Example 7 is repeated except that the NCO/OH ratio is adjusted to 0.99. The resultant polyurethane proves unspinnable with nylon 6 or nylon 11; poor melt strength or fiber-forming characteristics cause the polyurethane to strip back and flow irregularly on the polyamide component thereby causing excessive breaks in the extruding filaments.

EXAMPLE 10

The procedure of Example 7 was repeated except that the NCO/OH ratio was 1.06. This polyurethane product also showed poor melt strength and could not be melt spun conjugately without excessive broken filaments.

EXAMPLE 11

The spinning equipment referred to in Example 3 was set up to produce conjugate filaments of nylon 12 and the polyurethane polymer made according to Example 7. Nylon 12, type L1700 from Olin Chemicals Co., having a relative viscosity of 1.7 in m-cresol at 25° C. and a nominal melting point of 178° C. was charged to one extruder-melter and the polyurethane chips were charged to the other. Spinning conditions were:

| | |
|---|---|
| Melt-Extruder Outlet Temperature, | |
| Nylon 12 | 236° C. |
| Polyurethane | 214° C. |
| Spinning Block Temperature | 220° C. |
| Nylon 12/Polyurethane Ratio | 1:1 |
| Capillary Orifice Diameter | 25 mils |
| Spinning Speed | 300 y.p.m. |
| Spun Denier per Filament | 104 |
| % Finish on Yarn | 3.7 |

Spinning operations proceeded smoothly after the above noted temperature conditions had become steady. A large number of monofilament spincakes were collected. Upon being hand-drawn and released, the filaments immediately contracted into close helices similar to the yarns of Example 3.

Spincakes were stocked on a standard drawtwister and were machine-drawn as described in Example 4 except that the draw ratio was 3.36. The machine-drawn yarn was comparable to that produced in Example 4 and had the following average measured yarn properties:

| | |
|---|---|
| Denier | 29.3 |
| Tenacity | 3.84 gm/den. |
| Elongation | 41.9% |
| % Bulk | 69.4% |
| Shrinkage | 16.3% |

These filaments were also utilizable in stretch hosiery and other stretch fabrics. It was noted that somewhat longer exposure and slightly higher dye-bath temperature was required with nylon 12 than with nylon 6 or nylon 66 conjugate filaments when standard acid dyes were used.

EXAMPLE 12

The spinning operation outlined in Example 11 was continued except that nylon 11 was substituted for the nylon 12, and spinning temperatures were readjusted. The nylon 11 was type BCI nylon, number 1107, supplied by Belding Chemical Industries; relative viscosity in m-cresol was 71 and nominal melting point of the nylon 11 was 186° C. The changed spinning conditions were:

| | |
|---|---|
| Melt-Extruder Outlet Temperature, | |
| Nylon 11 | 246° C. |
| Polyurethane | 211° C. |
| Spinning Block Temperature | 230° C. |
| Spun Denier | 102 |

Spinning operations proceeded satisfactorily without sticking together of the filaments or excessive breakbacks. Several spincakes were collected and drawn on a conventional drawtwister at 3.36 draw-ratio. These filaments were very similar to other conjugate filaments according to the invention and could be utilized similarly. Average measured properties of drawn filaments were:

| | |
|---|---|
| Denier | 28.9 |
| Tenacity | 4.54 gm/den. |
| Elongation | 47.0% |
| % Bulk | 65.7% |
| Shrinkage | 17.8% |

EXAMPLE 13

The procedure of Example 7 is followed except that instead of the polyester, a poly (1,4-oxybutylene) glycol of about 1500 molecular weight and having a hydroxyl number of 70 is used. The resulting polyurethane has a DTA melting point of about 220°-225° C. This polyurethane can be satisfactorily melt spun conjugately with nylon 6 having relative viscosity of 32 and with nylon 66 having an RV of 29.

EXAMPLE 14

The procedure in Example 13 is followed except that a poly (1,2-oxypropylene) glycol with molecular weight of about 2000 and having a hydroxyl number of 55 is used. The polyurethane product has a DTA melting point of about 210°-215° C. and is melt spinnable conjugately with nylon 6 or nylon 610 without excessive sticking or break backs in spinning.

EXAMPLE 15

The polyurethane prepared in accordance with Example 7 above is melt spun conjugately with the polyester disclosed in Example 1 of U.S. Pat. No. 2,777,830. The spinning conditions are as set forth in Example 12 above except that the spinning block temperature was increased to 244° C. The spun yarn was next treated to render the polyester portion acid-dyeable as disclosed in U.S. Pat. No. 2,777,830, and was then hot drawn at a draw ratio of 3.55. The drawing temperature was 95° C. The resulting yarn was similar in physical properties to those noted in Example 11 above. Other additives useful for making polyesters and other hard fibers acid dyeable are disclosed in *Man-Made Fibers Science and Technology,* (1968), John Wiley and Sons, edited by Mark et al, Volume 3, pages 21-81.

Yarns having a breaking strength below 65 grams are too fragile to produce serviceable hose. For reasonable durability and resistance to picks and snags, the yarn should have a breaking strength of at least 65 grams, and preferably 70 grams or more. This effect is shown by the following wear tests.

A first yarn was prepared as in Example 7 above, cold drawn at a draw ratio of 4.0 to yield a 26 denier yarn having a breaking strength of 91 grams. Two other yarns were prepared as in Example 7, except that the polymer metering pumps were reduced in speed to reduce the spun deniers to 80 and 72, respectively. These latter two yarns were also cold drawn at a draw ratio of 4.0 to yield yarns having respective breaking strengths of 70 and 63 grams. The three yarns were knitted into ladies' panty hose and distributed to a test panel of models for wear testing. Half of the hose had failed after the number of days indicated below:

| Yarn Breaking Strength | Total No. of Garments | Days to 50% Failure |
|---|---|---|
| 91 grams | 40 | 10 days |
| 70 grams | 31 | 5 days |
| 63 grams | 27 | 2 days |

Each of the yarns in the above wear test contained 50% polyurethane by volume. For a given yarn breaking strength, it is sometimes possible to increase durability somewhat by increasing the amount of polyurethane relative to the hard fiber, although this is not practical due to the increased cost of materials. Thus hose knitted from a 20 denier yarn containing 60% polyurethane, the yarn having been cold drawn to a draw ratio of 4.0 and having a breaking strength of 61 grams, lasted 3 days until half the hose failed. The cost of materials in this yarn is considerably higher than in the above yarn having a breaking strength of 70 grams.

British Pat. 1,095,147 in Examples 1, 6, 7 and 13 therein refers to yarns conjugated from hard fibers and certain elastomeric polyurethanes. Of these, Example 13 is defective in that the description of the elastomer is so incomplete as to be obviously impossible to duplicate. British Pat. 1,095,147 states that the polyurethane components in Examples 1, 6 and 7 therein are prepared as described in Example 1 of British Pat. No. 1,040,365, but that they differ therefrom by their "inherent viscosity" and their "Vicat softening points". British Pat. No. 1,095,147 does not teach how to obtain these apparently different properties, nor does it suggest whether this is done by modifying the composition, the process, or both. Furthermore, British Pat. No. 1,095,147 does not disclose how these properties are measured. Thus, the temperature at which the "inherent viscosity" is to be measured is not stated. It appears from the partial definitions given that "inherent viscosity" means different things in the two British patents. As to the "Vicat softening point", British Pat. No. 1,095,147 does not specify the apparatus to be used, or the test conditions. One cannot practice any of these examples without excessive experimentation, and indeed, one cannot know that the examples have been duplicated due to these and other ambiguities in the disclosure. British Pat. No. 1,095,147 does not suggest that any of its yarns would be useful for hose. The yarns in Examples 1, 6 and 7 therein would be too fragile for practical application in this end use, since the highest breaking strength indicated is about 62 grams. The properties shown in Example 13 indicate that this incompletely disclosed yarn would be marginal in breaking strength, even though the denier is quite large.

The elastomeric polyurethanes referred to in British Pat. Nos. 1,095,147 and 1,040,365 are not suitable for accomplishing several of the objects of the present invention. The British patents are directed to polyurethanes formed from aliphatic or alicyclic diisocyanates, the diisocyanate being neither employed to excess nor present to excess at any time during the preparation. According to a major aspect of the present invention, superior spinning preformance and yarn physical properties are obtained if the diisocyanate is present to excess within narrow limits (NCO/OH ratio between 1.01 and 1.04). According to a further major aspect of the invention, resistance to acid dyes (with resulting apparent sheerness) is achieved if the isocyanate groups are hydrolyzable to give a reaction product having a pK value of at least 8 at 95° C. This is not achieved with polyurethanes according to the British patents.

As a further point of distinction, the polyurethanes disclosed in British Pat. No. 1,040,365 all melt below 200° C., since each of the examples specify that the reaction mixture is stirred and thus is in the molten state at 180° C. (Examples 6 and 7) or at 200° C. (remaining Examples). This may account for the unusually low tenacities achieved in British Pat. No. 1,095,147.

THE INITIAL MODULUS

Drawn and relaxed yarns according to the invention are extremely stretchable at low applied forces, as indicated by the gauge lengths at 0.1 grams per denier (Table VI) in comparison with the gauge lengths at 0.0012 grams per denier (10 cm.). Determination of a precise initial modulus for such a yarn is difficult because a slight error in preloading tension can cause a substantial change in initial gauge length. However, the initial modulus at a preloading tension of 0.0012 grams per denier is typically 0.001 grams per denier or less.

The initial modulus of drawn but not relaxed yarns is determined according to the procedure suggested in British Pat. No. 1,095,147, as follows. A 5 cm. test length of the as-spun filament (spun denier 104) is inserted between the jaws of the Instron Tensile Tester and extended to a draw ratio of 5.0 at a rate of 1000% per minute. The crosshead is immediately returned to the reset position at the same crosshead speed. The load recorded by the instrument decreased rapidly, becoming zero at a gauge length of 12.2 cm, which was used as a measure of the filament length with the crimp removed, as suggested by British Pat. No. 1,095,147. The denier would then be $$\frac{(104)\,(5)}{12.2},$$

or 42.6. After the crosshead returned to the reset position (5 cm. gauge length) it was immediately relowered at the same speed to generate a second loading curve. The initial modulus is calculated from the second loading curve as follows. The force in grams required to extend the yarn an additional 1% beyond a length of 12.2 cm. is read from the chart, this value being estimated at 0.015 grams. The initial modulus is then 100 times the required force divided by the denier, or $$\frac{(0.015)\,(100)}{42.6}.$$

For this particular sample, the initial modulus as thus defined is 0.035 gms./den./100% extension. The gauge length when the load returns to zero is somewhat variable with different yarn samples. However, the initial modulus for yarns made according to Example 7 herein are all less than about 0.1 when tested according to this procedure.

I claim:

1. A garment having a leg portion knitted from a helically crimped yarn, said yarn comprising two side-by-side substantially permanently conjugated components, one of said components being translucent and substantially undyed and the other of said components being dyed.

2. The stocking defined in claim 1, wherein said other of said components is acid-dyed.

3. The stocking defined in claim 1, wherein said yarn has a denier less than 40 and a breaking strength of at least 65 grams.

4. The garment defined in claim 1, wherein said leg portion has an index of compressive force uniformity of at least 275 gm. cm.

5. The garment defined in claim 1, wherein said leg portion has an index of compressive force uniformity of at least 330 gm. cm.

6. The garment defined in claim 1, wherein said yarn has an average modulus of less than 3.9.

7. The garment defined in claim 1, wherein said yarn has an average modulus of less than 2.5.

8. The garment defined in claim 1, wherein said yarn has an average modulus between 0.5 and 2.0.

9. The garment defined in claim 5, wherein said one of said components is formed from the reaction product of a. a polymeric glycol having a molecular weight between 800 and 3000,
b. between 4.4 and 8.8 mols of a diisocyanate per mole of said polymeric glycol, and
c. sufficient low molecular weight glycol having a molecular weight less than 500 to provide an NCO-/OH ratio between 1.01 and 1.04.

10. The garment defined in claim 9, wherein said diisocyanate, if reacted with water, yields a reaction product having a basic pK of at least 8.

11. The garment defined in claim 9, wherein the isocyanate groups in said diisocyanate are directly attached to an aromatic ring.

12. The garment defined in claim 5, wherein said leg portion has a knee size between 11 and 14.5 inches.

13. In a garment including a heel portion, the combination therewith of means for providing an index of compressive force unifority of at least 275 gm. cm., said means comprising a conjugate yarn knitted to form a knee portion of said garment, said conjugate yarn having an average modulus less than 3.9, wherein said conjugate yarn comprises two side-by-side polymer components, one of said components being substantially undyed and the other of said components being dyed.

14. In a garment including a heel portion, the combination therewith of means for providing an index of compressive force uniformity of at least 275 gm. cm., said means comprising a conjugate yarn knitted to form a knee portion of said garment, said conjugate yarn having an average modulus less than 3.9, wherein said one of said components is formed from the reaction product of a. a polymeric glycol having a molecular weight between 800 and 3000,
b. between 4.4 and 8.8 mols of a diisocyanate per mol of said polymeric glycol, and
c. sufficient low molecular weight glycol having a molecular weight less than 500 to provide an NCO-/OH ratio between 1.01 and 1.04.

15. The garment defined in claim 14, wherein said diisocyanate, if reacted with water, yields a reaction product having a basic pK of at least 8.

16. The garment defined in claim 14, wherein the isocyanate groups in said diisocyanate are directly attached to an aromatic ring.

17. The garment defined in claim 14, wherein said knee portion has a knee size between 11 and 14.5 inches.

18. The garment defined in claim 14, wherein said yarn has a denier less than 40 and a breaking strength of at least 65 grams.

* * * * *